United States Patent [19]

Daniels

[11] 3,960,197

[45] June 1, 1976

[54] SCREEN AND STORM SASH CONSTRUCTION

[76] Inventor: Phillip D. Daniels, 40200 Grand River Ave., Novi, Mich. 48050

[22] Filed: Nov. 8, 1974

[21] Appl. No.: 522,027

[52] U.S. Cl. ..... 160/371; 160/404
[51] Int. Cl.[2] ..... A47G 5/00
[58] Field of Search ..... 160/371, 374.1, 380, 160/381, 404

[56] References Cited

UNITED STATES PATENTS

| | | | |
|---|---|---|---|
| 493,664 | 3/1893 | Stone | 160/381 |
| 2,091,765 | 8/1937 | McKee | 160/404 |
| 2,314,026 | 3/1943 | Willett | 160/371 |
| 2,559,573 | 7/1951 | Unwin | 160/404 |
| 2,784,781 | 3/1957 | Rhoades | 160/371 |
| 3,552,476 | 1/1971 | LeTarte | 160/371 |
| 3,674,082 | 7/1972 | Letarte | 160/371 |
| 3,696,857 | 10/1972 | LeTarte | 160/371 |
| 3,729,045 | 4/1973 | MacDonald | 160/371 |

FOREIGN PATENTS OR APPLICATIONS

| | | | |
|---|---|---|---|
| 1,186,436 | 6/1959 | France | 160/404 |

*Primary Examiner*—Robert L. Wolfe
*Assistant Examiner*—Victor N. Sakran
*Attorney, Agent, or Firm*—Cullen, Settle, Sloman & Cantor

[57] ABSTRACT

A screen assembly comprises a hollow or semi-hollow frame with interconnected side and end sections. Each section has a hollow channel portion terminating in a continuous screen ledge intermediate its opposite sides providing a peripheral support. A series of longitudinally spaced projections extend from said ledge adapted to retainingly engage and extend through peripheral portions of a screen spanning said frame and bearing upon said screen ledge. A removable apertured strip overlies said screen and said screen ledge retainingly engaging said projections and screen. A continuous glass support ledge is laterally displaced and extends from the screen ledge, and is adapted to alternately support a glass defining a storm window; said strip overlying and retainingly engaging said glass.

2 Claims, 7 Drawing Figures

SCREEN AND STORM SASH CONSTRUCTION

BACKGROUND OF THE INVENTION

Heretofore in the construction of screen assemblies employing hollow frames with side and end sections there has been provided an internal and continuous bead channel in said sections into which peripheral portions of the screen are folded with the screen being anchored by a removable beading, which by a suitable tool is projected down into the channel to frictionally and retainingly engage said screen portions.

The use of this assembly is time consuming and normally requires the use of a tool not only for forming the peripheral portions of the screen into a right angular corner, but in also projecting the beading down into the bead channel forming a part of the channel assembly for the purpose of anchoring the screen.

BRIEF DESCRIPTION OF THE INVENTION

It is an object of the present invention to provide an improved screen assembly and frame wherein bead and the support channel form within the frame sections are eliminated and wherein there is merely provided an internal continuous screen support ledge. A series of projections along the ledge extend through peripheral portions of the screen and are adapted to retainingly receive removable trim strips which anchor the screen in position.

By this construction, the screen is unfolded at its peripheral edge eliminating the use of a tool and the bending step, and the screen is held in place merely by the trim strip which retainingly engages the projections.

It is another object to provide an improved screen assembly which represents a simplification over the older type of conventional screen and wherein the screen may be assembled to and secured to the frame without the use of tools or special skills.

It is another object to include as a portion of the frame assembly a secondary laterally displaced continuous glass support ledge, adapted to receive a rectangular pane, in the place of a screen, said pane being held in position by the aforesaid trim strip without the use of any tools or fastening devices.

These and other objects will be seen from the following specification and claims in conjunction with the appended drawing.

THE DRAWING

DETAILED DESCRIPTION OF THE INVENTION

It will be understood that the above drawing illustrates merely a preferred embodiment of the invention, and that other embodiments are contemplated within the scope of the claims hereafter set forth.

Figure 2:
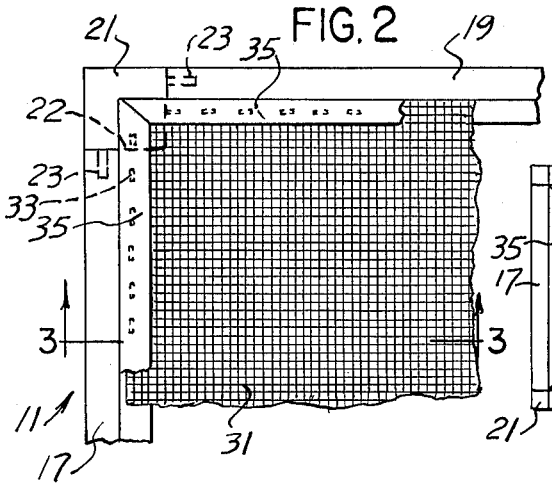
FIG. 2 is a similar view of a fragmentary portion of the screen assembly on an increased scale.
Figure 1:
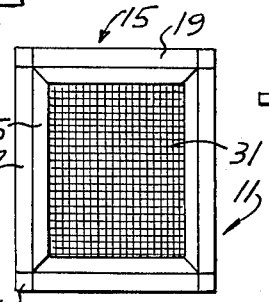
FIG. 1 is a reduced scale front elevational view of the present screen assembly.

Referring to the drawing, the present screen 11 FIGS. 1 and 2 includes a frame 15 with interconnected pairs of side and end sections 17 and 19. These sections are interconnected by the plurality of corner lock blocks 21.

Each of the sections includes a formed or extruded elongated channel portion 25. Each of the corner lock blocks includes elongated projections 23 of rectangular shape in cross section adapted to snugly and frictionally and interlockingly project within corresponding ends of the side and end sections as shown in FIG. 2.

Accordingly, the corresponding side and end sections are not mitered as is conventional in this type of construction, but on the other hand abut the corner lock blocks 21.

As shown in FIG. 2, since the sections abut the lock blocks 21 by straight across edges, there will be defined a rectangular opening between the adjacent ends of the right angular related sections 17 and 19. This space is filled by rectangular extension 22, or webbing which is inset from one side of the corner block thus filling the space between the registering ends of said sections.

Each of the channel portions 25 terminate in a continuous screen ledge 27 which projects laterally inward of said channel portion intermediate its opposite sides to thus provide a peripheral support.

Figure 4:
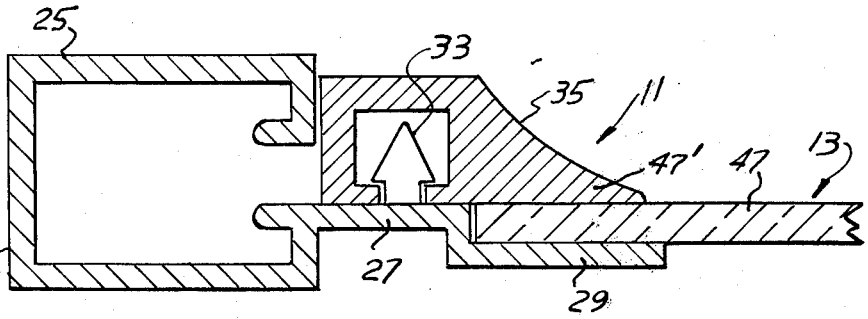
FIG. 4 is a similar view, except that a glass pane is mounted within a frame instead of a screen to provide a storm sash.

In order that the present frame assembly may be used for storm sash as at 13 FIG. 4, a continuous glass support ledge 29 is laterally offset from and projects inwardly of said screen ledge and is adapted to peripherally support the glass 47 FIG. 4, which spans said frame.

A series of longitudinally spaced projections 33 extend from the screen ledge 27 at right angles thereto and are adapted to project through and to retainingly receive peripheral edge portions of a flat rectangular screen 31 which spans said frame and bears upon the ledges 27 throughout 360°.

The projections 33 as shown in FIG. 2 form an integral part of the screen ledge. Under some conditions, said projections may be sufficient for retainingly engaging the screen 31 without the use of the trim strip 35.

In a preferred embodiment of the present invention, there is employed a removable trim strip 35, of channel form defined by the channel 37 which has a continuous entrant opening 39 of reduced dimension adapted to receive the series of longitudinally spaced locking projections 33.

Said projections have lock portions 41 defining a barbed head of increased dimension with respect to the entrant opening 39 in order to interlockingly engage said trim strip 35.

Said trim strip is thus manually projected in a snap fastening manner over the said projections 33 retainingly engaging said projections and retainingly engaging peripheral portions of screen 31 anchoring it in place and finishing the construction. Portions of the trim strip 35 have internal extensions 47' FIG. 4, which are juxtaposed over and spaced from the glass support ledges 29 adapted to retainingly engage the glass or glass pane 47 mounted upon said glass ledge.

In this construction, FIG. 4, the screen 31 is not employed however the screen ledge 27 supports the trim strip 35 in the same manner as described with respect of FIG. 1. At the same time the trim strip extension 47' operatively and retainingly engages peripheral portions of the glass 47 for anchoring the glass against the glass ledge 29 to complete a storm sash construction.

Figure 6:
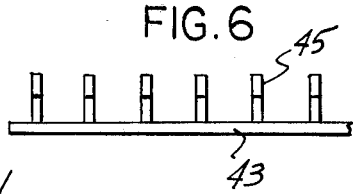
FIG. 6 is a fragmentary side elevational view of the locking strip and projections of FIG. 5.
Figure 3:
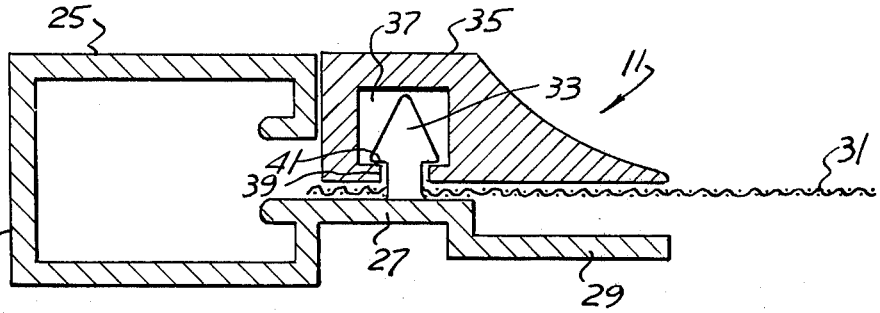
FIG. 3 is a fragmentary section on an increased scale taken in the direction of arrow 3—3 of FIG. 1.
Figure 5:
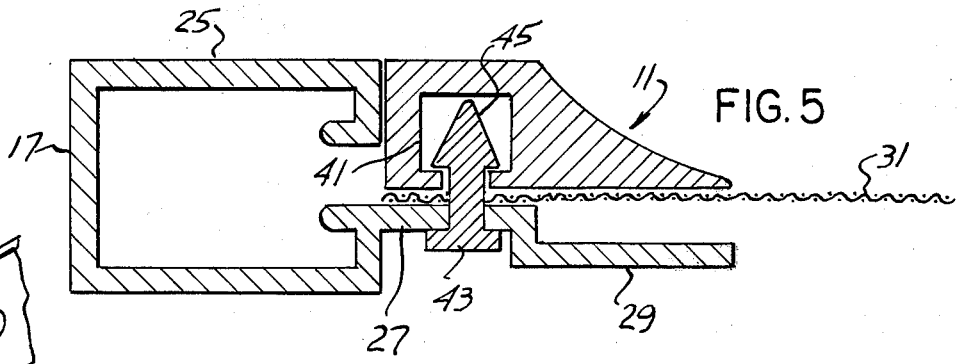
FIG. 5 is a view similar to FIG. 3 showing a slight modification with the locking projections shown independent of the channel frame construction.

While, in FIG. 3 the locking projections 33 are shown as an integral part of the screen ledge 27, it is contemplated that these projections may be separable therefrom as shown in FIG. 5. In this construction, similar to what is shown in FIG. 3, there is provided a lock strip 43 also shown in FIG. 6, from which there are a series of longitudinally spaced locking projections 45 similar to the projections 33. These extend through corresponding apertures in the screen ledge 27, extend through peripheral portions of the screen 31 and are interlockingly received by the corresponding trim strip 35.

Though the projections 33 shown in FIG. 1 are shown as integral with screen ledge 27, it is contemplated these projections could be struck out from said ledge after the extrusion of the side and end sections. The corner portions of the trim strips 35 are mitered in the conventional manner as shown in FIG. 2.

By the present frame construction while this may have been intended in the first instance to be used for screens, the frame construction has the alternate use of providing a storm sash assembly such as shown in FIG. 4. In this construction the screen ledge 27 is also used to provide the support for the trim strip 35.

In the preferred embodiment of the invention the side and end sections 17 and 19 which define the channel portions 25, and including the respective ledges 27 and 29 may be extruded of aluminum or a plastic material.

Figure 7:
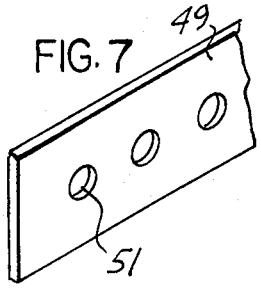
FIG. 7 is a fragmentary perspective view of a modified trim strip.

FIG. 7 shows in perspective a modified flexible trim or anchor strip 49 of plastic material with a series of spaced apertures 51. These are adapted to receive and interlock with projections 33.

Having described my invention, reference should now be had to the following claims, I claim:

1. A storm window assembly comprising a hollow frame including interconnected pairs of side and end sections;

said sections including a formed, elongated channel portion, a continuous screen ledge projecting laterally inward of said channel portion intermedidate its opposite sides providing a peripheral support;

a series of longitudinally spaced projections on and along said screen ledge;

a continuous glass support ledge laterally offset from and projecting inwardly of said screen ledge;

a rectangular glass within said frame spanning and overlying said glass support ledge; and a removable trim strip of channel form overlying said screen ledge and glass support ledge retainingly engaging said projections and overlying and retainingly engaging peripheral portions of said glass.

2. A screen assembly comprising a hollow frame including interconnected pairs of side and end sections;

said sections including a formed, elongated channel portion;

a continuous screen ledge projecting laterally inward of said channel portion intermediate its opposite sides providing a peripheral support;

a series of longitudinally spaced projections on and along said screen ledge;

a rectangular screen within said frame spanning and overlying said screen ledge;

said projections extending through and anchoring peripheral portions of said screen;

a removable trim strip of channel form overlying said screen and screen ledge retainingly engaging said screen and said projections;

said trim strip having a continuous entrant opening to its channel;

said series of projections extending inwardly through said entrant opening interlocking with said trim strip.

* * * * *